US009521882B2

(12) United States Patent
Hung

(10) Patent No.: US 9,521,882 B2
(45) Date of Patent: Dec. 20, 2016

(54) SAFETY BELT BUCKLE

(71) Applicant: YOKE INDUSTRIAL CORP., Taichung (TW)

(72) Inventor: Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 141 days.

(21) Appl. No.: 14/195,076

(22) Filed: Mar. 3, 2014

(65) Prior Publication Data

US 2015/0089777 A1 Apr. 2, 2015

(30) Foreign Application Priority Data

Oct. 2, 2013 (TW) ..... 102135698 A

(51) Int. Cl.
*A44B 11/25* (2006.01)
*A44B 11/26* (2006.01)

(52) U.S. Cl.
CPC ..... *A44B 11/2511* (2013.01); *A44B 11/263* (2013.01); *A44B 11/2519* (2013.01); *Y10T 24/45241* (2015.01)

(58) Field of Classification Search
CPC ..... A44B 11/2511; A44B 11/2546; A44B 11/263; A44B 11/26
USPC ..... 24/648, 634, 625, 594.1, 593.1
See application file for complete search history.

(56) References Cited

U.S. PATENT DOCUMENTS 3,168,770 A * 2/1965 John, Jr. ..... A44B 11/2519 24/648
3,201,840 A * 8/1965 Jantzen ..... A44B 11/2519 24/634
3,262,169 A * 7/1966 Jantzen ..... A44B 11/2526 24/196
3,404,439 A * 10/1968 Jones ..... A44B 11/2526 24/603
3,523,342 A * 8/1970 Spires ..... A44B 11/2511 24/632
3,605,210 A * 9/1971 Lohr ..... A44B 11/2511 24/635
3,648,333 A * 3/1972 Stoffel ..... A44B 11/2511 24/635
3,649,999 A * 3/1972 Stoffel ..... A44B 11/2511 24/635
3,807,000 A * 4/1974 Weman ..... A44B 11/2511 24/655

(Continued)

*Primary Examiner* — Robert J Sandy
*Assistant Examiner* — Jason W San
(74) *Attorney, Agent, or Firm* — Ming Chow; Sinorica, LLC

(57) ABSTRACT

A safety belt buckle includes a buckle member, a hook, a stop member, and a latch member. The buckle member has a chamber therein, which is communicated with an opening. The latch member has a tongue plate which is inserted into the chamber through the opening. The stop member and the hook are provided in the chamber, and the latch member is not able to be detached from the buckle member because that the stop member stops the hook from moving to engage the tongue plate. By pressing a press button on the stop member, the stop member is moved to a predetermined position, and no longer stops the hook from disengaging the tongue plate. The latch member is able to be detached from the buckle member at this time.

6 Claims, 5 Drawing Sheets

(56) References Cited

U.S. PATENT DOCUMENTS 4,068,354 A * 1/1978 Loomba ..... A44B 11/2523 24/641
4,228,567 A * 10/1980 Ikesue ..... A44B 11/2511 24/642
4,317,263 A * 3/1982 Fohl ..... A44B 11/2511 24/635
4,377,888 A * 3/1983 Ikesue ..... A44B 11/2511 24/637
4,385,424 A * 5/1983 Petersen, III ..... A44B 11/2511 24/633
4,577,378 A * 3/1986 Harenberg ..... A44B 11/2511 24/633
4,642,857 A * 2/1987 Ono ..... A44B 11/2511 24/637
4,766,654 A * 8/1988 Sugimoto ..... A44B 11/2511 24/637
4,949,436 A * 8/1990 Anscher ..... A44B 11/263 24/616
5,138,751 A * 8/1992 Shima ..... A44B 11/2511 24/637
5,142,748 A * 9/1992 Anthony ..... A44B 11/2511 24/579.11
5,267,377 A * 12/1993 Gillis ..... A44B 11/2511 24/633
5,269,051 A * 12/1993 McFalls ..... A44B 11/2511 24/632
5,283,933 A * 2/1994 Wiseman ..... A44B 11/2511 24/579.11
5,406,681 A * 4/1995 Olson ..... A44B 11/2511 24/579.11
5,419,020 A * 5/1995 Murai ..... A44B 11/266 24/625
5,465,472 A * 11/1995 Matoba ..... A44B 11/266 24/616
5,606,783 A * 3/1997 Gillis ..... A44B 11/2511 24/628
5,709,014 A * 1/1998 Takahashi ..... A44B 11/2511 24/614
5,832,573 A * 11/1998 Howell ..... A44B 11/2526 24/616
5,857,247 A * 1/1999 Warrick ..... B64D 17/32 24/603
5,979,026 A * 11/1999 Anthony ..... A44B 11/2511 24/633
6,170,133 B1 * 1/2001 Uehara ..... A44B 11/2511 24/614
6,205,629 B1 * 3/2001 Becker ..... A44B 11/2523 24/303
6,560,830 B1 * 5/2003 Chi ..... A44B 11/266 24/616
6,668,434 B2 * 12/2003 Casebolt ..... A44B 11/253 24/265 BC
6,965,231 B1 * 11/2005 Cinoglu ..... A61B 5/0555 324/300
7,089,633 B2 * 8/2006 Liu ..... A44B 11/266 24/615
7,114,225 B2 * 10/2006 Casebolt ..... A44B 11/253 24/265 BC
7,275,613 B2 * 10/2007 Park ..... B60R 22/321 180/270
7,350,277 B1 * 4/2008 Canfield ..... A44B 11/253 24/634
7,373,701 B2 * 5/2008 Coulombe ..... A44B 11/253 24/171
8,176,605 B2 * 5/2012 Mok ..... A44B 11/266 24/613
8,181,319 B2 * 5/2012 Johnson ..... A44B 11/253 182/3
8,281,464 B2 * 10/2012 Shen ..... A44B 11/266 24/614
8,561,268 B2 * 10/2013 Hortnagl ..... A44B 11/2592 24/625
8,572,820 B2 * 11/2013 Richards ..... A44B 11/2519 24/634
8,950,780 B2 * 2/2015 Betz ..... A44B 11/2515 24/633
2002/0184742 A1 * 12/2002 Casebolt ..... A44B 11/253 24/634
2006/0048350 A1 * 3/2006 Coulombe ..... A44B 11/253 24/634
2006/0048351 A1 * 3/2006 Casebolt ..... A44B 11/253 24/634
2009/0013510 A1 * 1/2009 Liang ..... A44B 11/266 24/648
2009/0100652 A1 * 4/2009 Mok ..... A44B 11/266 24/625
2010/0263176 A1 * 10/2010 Lee ..... A44B 11/2573 24/593.1
2010/0314930 A1 * 12/2010 Akaike ..... A44B 11/2523 297/468
2012/0124790 A1 * 5/2012 Richards ..... A44B 11/2519 24/593.1
2013/0328378 A1 * 12/2013 Merrick ..... B60R 22/18 297/483
2014/0082902 A1 * 3/2014 Hortnagl ..... A44B 11/10 24/664

* cited by examiner

SAFETY BELT BUCKLE

The current application claims a foreign priority to the patent application of Taiwan No. 102135698 filed on Oct. 2, 2013.

BACKGROUND OF THE INVENTION

1. Technical Field

The present invention relates generally to a safety belt, and more particularly to a safety belt buckle.

2. Description of Related Art

Safety belts play an important role in traffic safety, for example, their binding force could counteract inertia on passengers at the moment when car accident happens, which effectively protects passengers from serious injuries. That is why there are strict mandatory traffic regulations about the usage of seat belts among various countries worldwide. What's more, safety belts are not only applied in vehicles, but also widely applied in many circumstances that have safety requirements, such as aircrafts, watercrafts, rides in amusement parks, and some working environment with high risk, to provide protection for passengers or workers. In fact, safety belts have become some kind of indispensable equipment in many people's daily life.

Generally, safety belts are tied by securing a buckle, but the conventional safety belt buckles can be released by pressing a single button. Though convenient, the safety belts may be unexpectedly unbuckled by misaction. And the unbuckling process is too simple to prevent children from releasing the safety belt buckles, and accidents might happen because of that. Therefore, the safety belt buckles still need to be improved.

BRIEF SUMMARY OF THE INVENTION

In view of the above, the primary objective of the present invention is to provide a safety belt buckle, which may prevent the safety belt from being unbuckled unexpectedly.

The present invention provides a safety belt buckle, which includes a buckle member, a hook, a stop member, and a latch member, wherein the buckle member has a chamber therein and an opening, wherein the opening is communicated with the chamber; the hook is provided in the chamber of the buckle member to be moved between a first position and a second position, wherein the hook stays at the first position under a normal condition; the stop member is provided in the chamber of the buckle member to be moved between a third position and a fourth position, wherein the stop member stays at the third position under a normal condition, the stop member includes a press button which has a bearing face outside the buckle member, and when the stop member is moved to the third position, a part of the stop member is on a moving trace of the hook to stop the hook from being moved to the second position from the first position; the latch member has a tongue plate to be inserted into the chamber of the buckle member through the opening, wherein the hook engages the tongue plate to let the latch member unable to be detached from the buckle member when the hook is moved to the first position.

By pressing the bearing face of the press button, the stop member is moved backward to the fourth position from the third position, and therefore the hook can be moved to the second position, which allows the tongue plate to be disengaged from the hook, so that the buckle member is detached from the buckle member. In other words, if a user wants to detach the latch member from the buckle member, he/she has to press the press button first, and then move the hook to the second position. Therefore, a safety belt tied by the safety belt buckle is impossible to be unbuckled by misaction.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
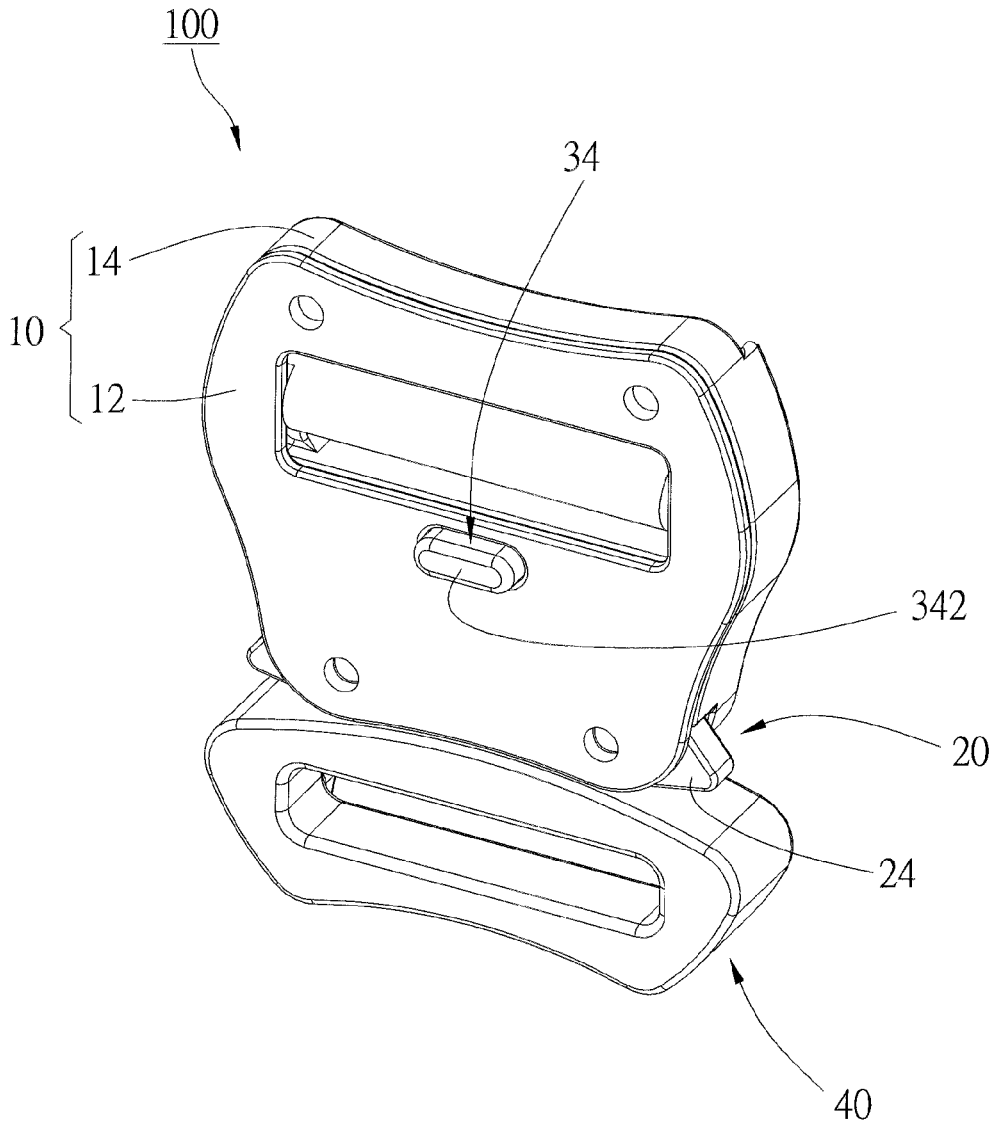
FIG. 1 is a perspective view of a preferred embodiment of the present invention.
Figure 2:
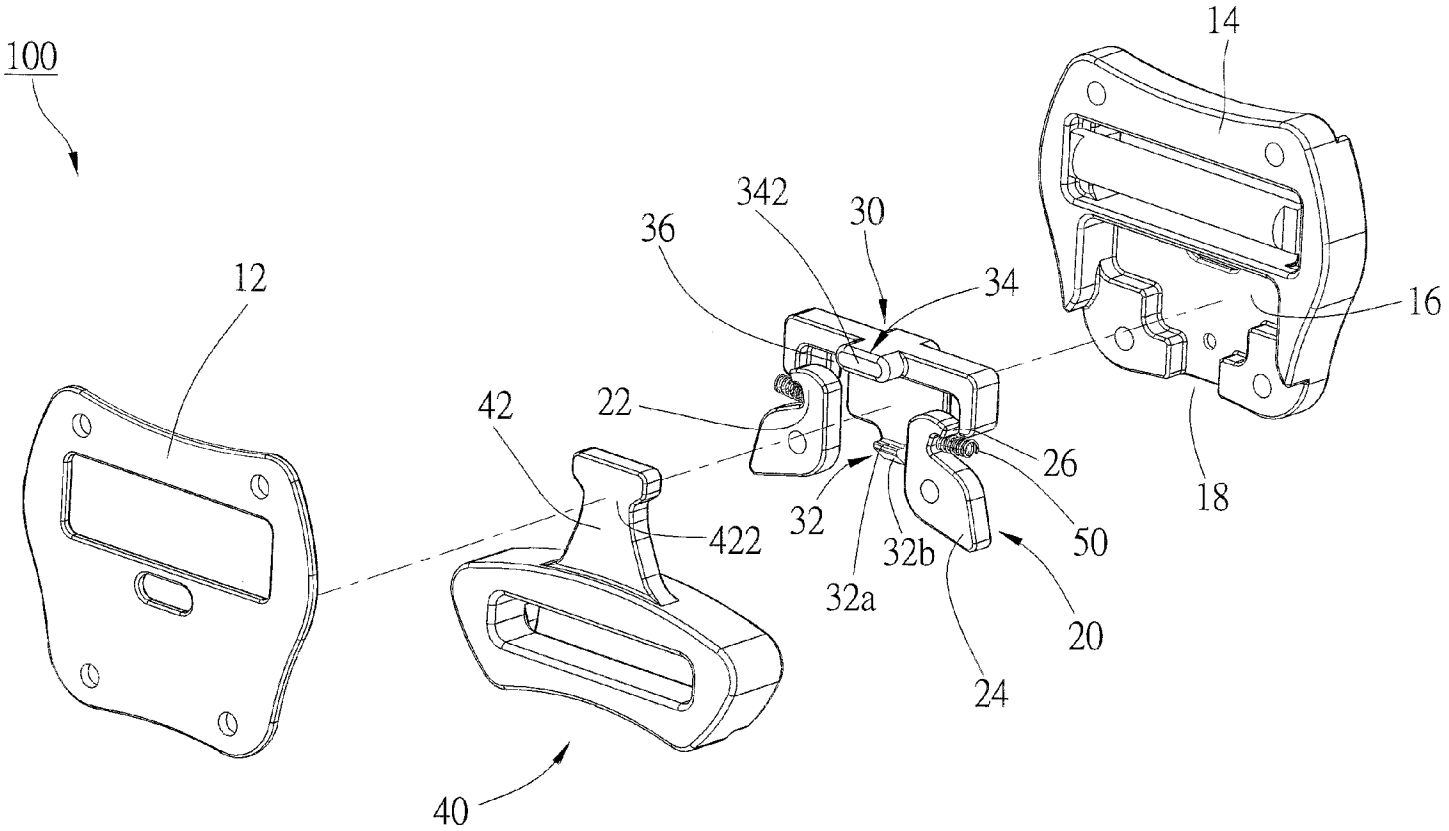
FIG. 2 is an exploded view of the preferred embodiment of the present invention.
Figure 3:
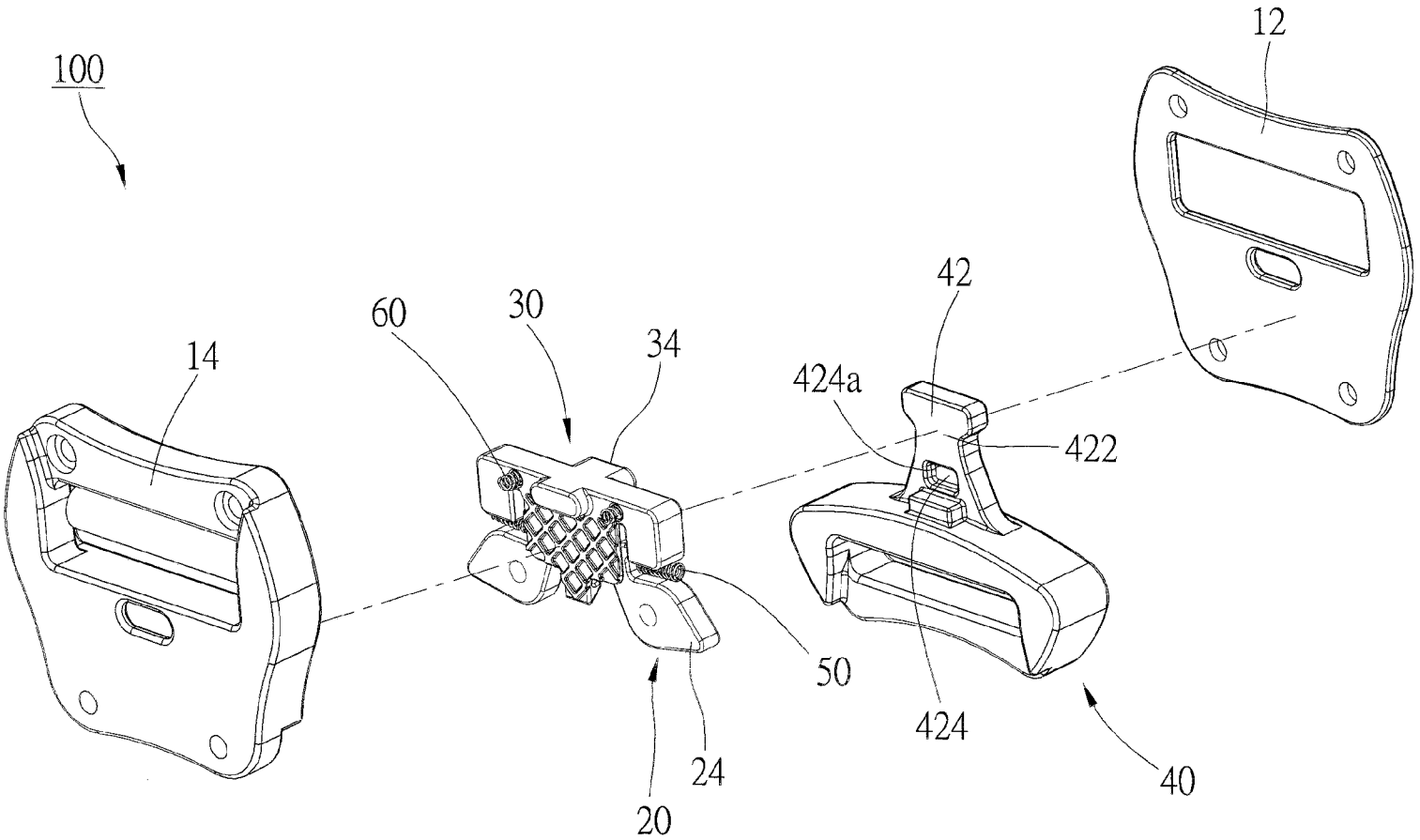
FIG. 3 is another exploded view of the preferred embodiment of the present invention.
Figure 4:
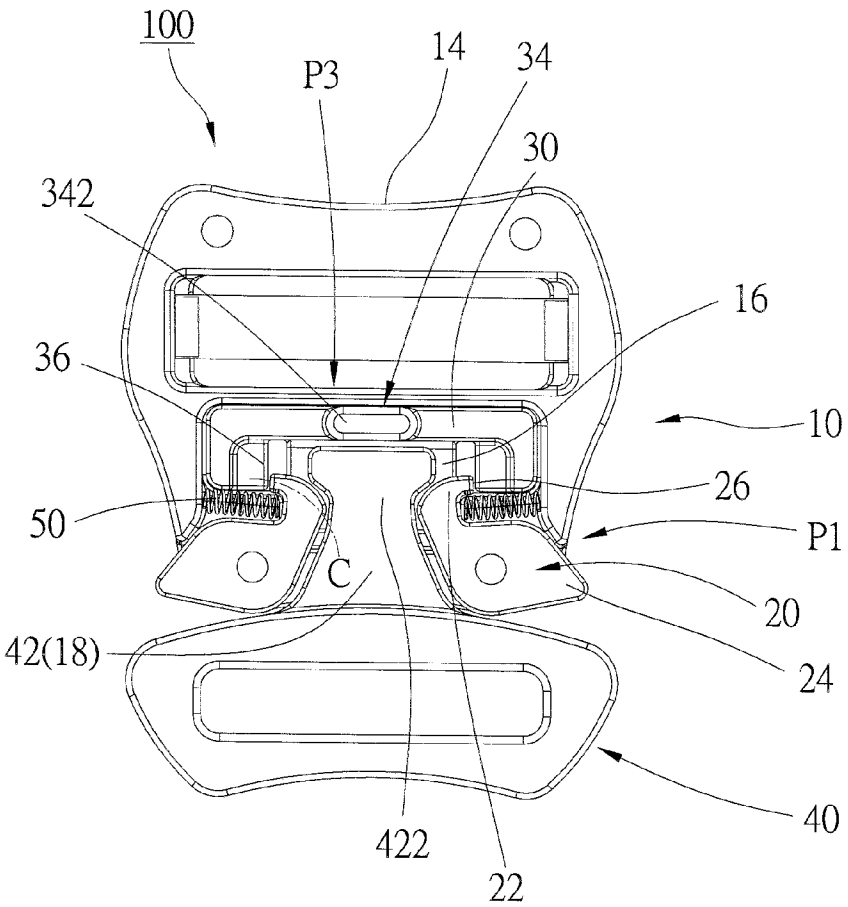
FIG. 4 is a perspective view of the preferred embodiment of the present invention, showing the engagement of the latch member and the buckle member.
Figure 5:
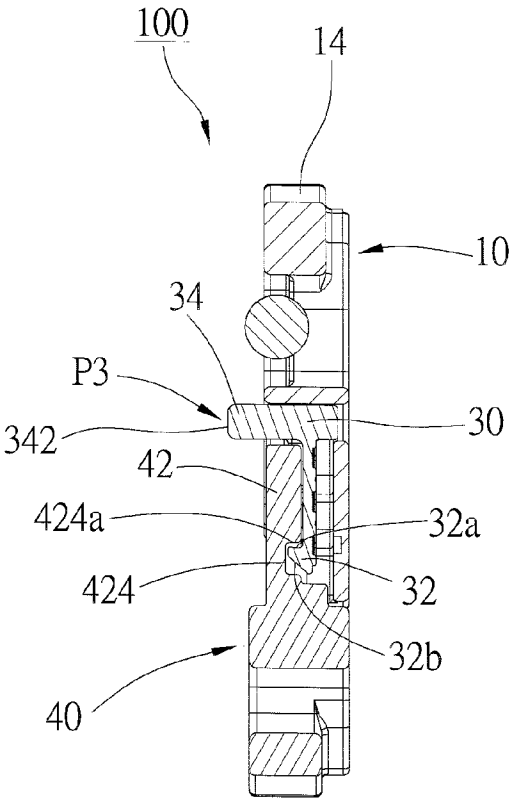
FIG. 5 is a sectional view of the preferred embodiment of the present invention, showing the stop member at the third position.

As shown in FIG. 1 to FIG. 7, a safety belt buckle 100 of the preferred embodiment of the present invention includes a buckle member 10, two hooks 20, a stop member 30, a latch member 40, two springs 50, and two elastic members 60. The buckle member 10 has a ceiling 12 and a base 14, and the ceiling 12 is connected to the base 14 to define a chamber 16 therebetween. The base 14 has an opening 18 in communication with the chamber 16. The latch member 40 includes a tongue plate 42 which has a neck 422 and a recess 424, and the tongue plate 42 is inserted into the chamber 16 of the buckle member 10 through the opening 18.

The two hooks 20, which are identical in structure, are provided in the chamber 16 of the buckle member 10. Each hook 20 can be moved between a first position P1 (FIG. 4) and a second position P2 (FIG. 6), and in the preferred embodiment, each hook 20 is pivoted on the buckle member 10. The two hooks 20 have a hooking portion 22 at an end respectively, and have a contact portion 24 at an opposite end thereof, wherein the two contact portions 24 are exposed out of the buckle member 10, and can be pushed to pivot the hooks 20. When the two hooks 20 are at the first position P1, each hooking portion 24 engages two sides of the neck 422 of the tongue plate 42. Besides, the two springs 50 are provided in the chamber 16 of the buckle member 10, and are used to urge each hook 20 to move toward the first position P1 respectively. In a normal condition, the hooks 20 are at the first position P1 by pushing forces of the springs 50, so that each hooking portion 22 is guaranteed to firmly engage the two sides of the neck 422 of the tongue plate 42.

Figure 6:
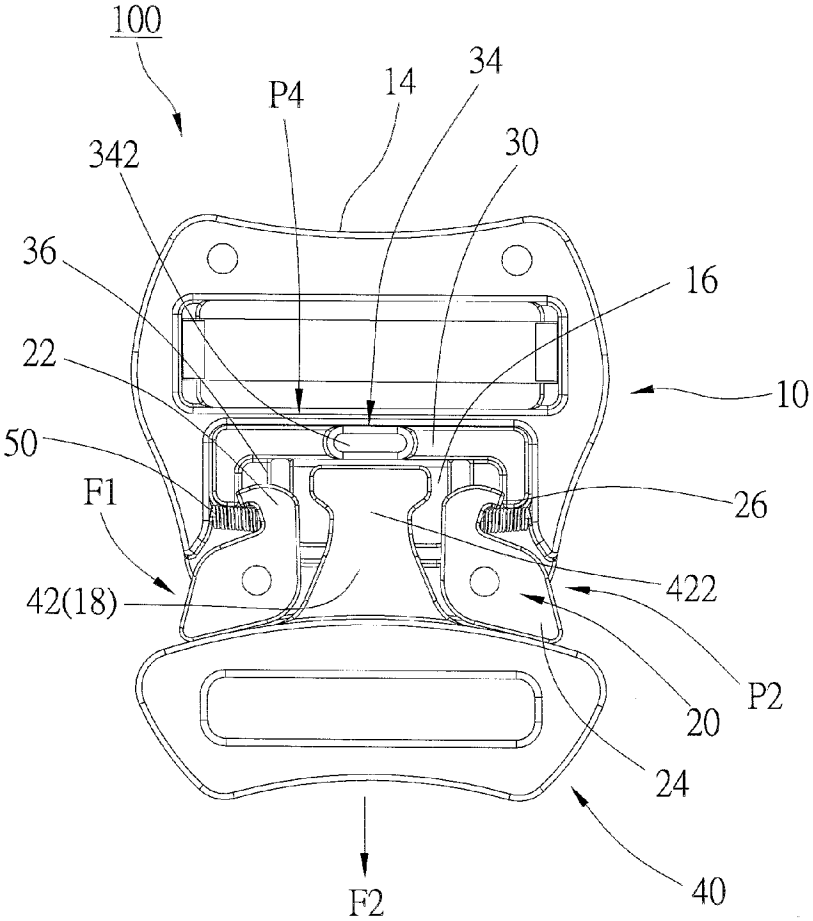
FIG. 6 is a perspective view of the preferred embodiment of the present invention, showing the disengagement of the latch member and the buckle member.
Figure 7:
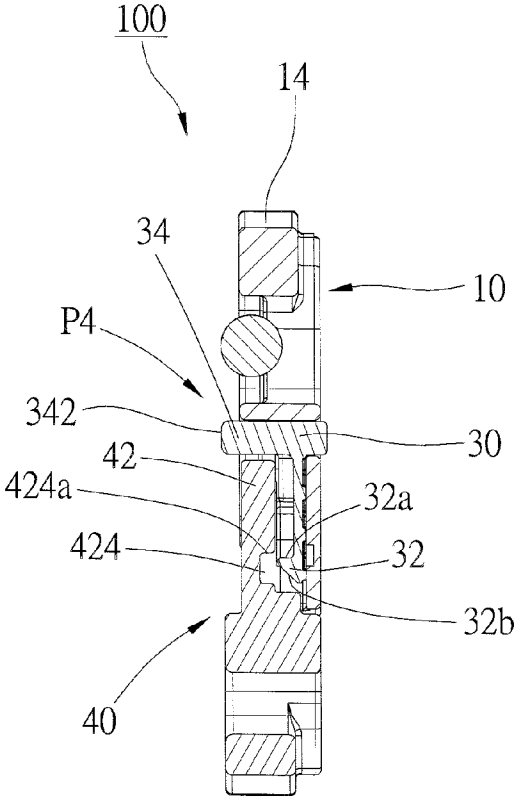
FIG. 7 is a sectional view of the preferred embodiment of the present invention, showing the stop member at the fourth position.

The stop member 30 is provided in the chamber 16, and can be moved between a third position P3 (FIG. 4 and FIG. 5) and a fourth position P4 (FIG. 6 and FIG. 7). More specifically, the stop member 30 is moved between the third position P3 and the fourth position P4 along with a direction vertical to the ceiling 12. The stop member 30 includes a protrusion 32, a press button 34, and two stop faces 36 which are set bilaterally symmetrical, wherein the press button 34 is exposed out of the buckle member 10 in the preferred embodiment, and the press button 34 has an exposed bearing face 342. By pressing the bearing face 342 of the press button 34, the stop member 30 is moved to the fourth position P4 from the third position P3. Besides, the two elastic members 60 are provided in the chamber 16 of the buckle member 10 to urge the stop member 30 to the third position P3. Therefore, the stop member 30 is at the third position P3 under a normal condition.

Each hook 20 has an end face 26, and the end face 26 moves along with a predetermined trace C (the imaginary line seen in FIG. 4, which is an arc line in the preferred embodiment) as each hook 20 is pivoted between the first position P1 and the second position P2. When the stop member 30 is at the third position P3, the two stop faces 36 are just on each predetermined trace C respectively, and each stop face 36 touches the end face 26 of one of the hook 20. Therefore, the two hooks 20 are stopped from moving to the second position P2 from the first position P1. At the same time, the protrusion 32 of the stop member 30 is received in the recess 424 of the tongue plate 42. Preferably, the recess 424 has a wall 424*a*, and the protrusion 32 has an engaging face 32*a*. The engaging face 32*a* touches the wall 424*a* to make the tongue plate 42 unable to be moved toward the opening 18 of the buckle member 10, which also helps to stop the latch member 40 from being detached from the buckle member 10. Please refer to FIG. 4 and FIG. 5, when the stop member 30 is at the third position P3, the two hooks 20 are stopped at the first position P1, and the two hooking portions 22 engage the two sides of the neck 424 firmly, and the protrusion 32 of the stop member 30 and the recess 424 of the tongue plate 42 touch each other with the wall 424*a* and the engaging face 32*a*, and therefore the latch member 40 is unable to be detached from the buckle member 10.

Please refer to FIG. 6 and FIG. 7, when a user wants to detach the latch member 40 from the buckle member 10, he/she has to press the bearing face 342 of the press button 34 to move the stop member 30 to the fourth position P4 from the third position P3. At this time, the protrusion 32 of the stop member 30 leaves the recess 424 of the tongue plate 42, and the end faces 26 of the two hooks 20 no longer touch the two stop faces 36 of the stop member 30. Therefore, the two hooks 20 can be pivoted to the second position P2 from the first position P1 by exerting a first force F1 onto the two contact portions 24, and the neck 422 of the tongue plate 42 is then disengaged from the two hooking portions 22. At this time, the user only needs to exert a second force F2 onto the latch member 40 to detach the latch 40 from the buckle member 10.

Furthermore, a side of the protrusion 32 of the stop member 30 has a slope 32*b*, and a thickness of the protrusion 32 is decreasing gradually toward the opening 18. Whereby, when the tongue plate 42 is inserted into the chamber 16 through the opening 18, the tongue plate 42 touches the slope 32*b* to move the protrusion 32, and therefore the stop member 30 is moved backward to the fourth position P4 temporarily, and the two stop faces 36 have no contact with the end faces 26 of the two hooks 20. In other words, as the tongue plate 42 is entering the chamber 16, the two hooks 20 can be pivoted to the second position P2, which allows the tongue plate 42 to be moved to a predetermined connecting position without obstruction. Once the tongue plate 42 is at the predetermined connecting position, the protrusion 32 is just received in the recess 424 of the tongue plate 42, and the protrusion 32 is no longer pushed by the tongue plate 42, the stop member 30 is then back to the third position P3. As a result, the latch member 40 and the buckle member 10 can be connected firmly with the aforementioned design of the present invention.

The hooks 20, the stop faces 36 of the stop member 30, the springs 50, and the elastic members 60 are all bilateral symmetric, which needs to be specified that the positions and the quantities of these components are not a limitation of the present invention. These components could be only single one in other embodiments, and the action principles between each component are roughly the same with the description above in such cases.

According to the explanation above, the safety belt buckle 100 of the present invention is not able to be released easily once the buckle member 10 and the latch member 40 are attached to each other. The user has to press the press button 34 and to pivot the two hooks 20 at the same time, and then the latch member 40 can be detached from the buckle member 10, which prevents the safety belt from being unbuckled by misaction. It must be pointed out that the embodiments described above are only some preferred embodiments of the present invention. All equivalent structures which employ the concepts disclosed in this specification and the appended claims should fall within the scope of the present invention.

What is claimed is:

1. A safety belt buckle, comprising:

a buckle member having a chamber therein and an opening, wherein the opening is communicated with the chamber;

a hook provided in the chamber of the buckle member to be moved between a first position and a second position, wherein the hook has a contact portion exposed out of the buckle member, the hook stays at the first position without being touched from the outside of the buckle member;

a stop member provided in the chamber of the buckle member to be moved between a third position and a fourth position, wherein the stop member comprises a press button which has a bearing face outside the buckle member, and when the stop member stays at the third position, a part of the stop member is on a moving trace of the hook to stop the hook from being moved to the second position from the first position, wherein the stop member allows the hook to be moved when staying at the fourth position, wherein the third position and the fourth position are distinct from the first position and the second position, and the stop member stays at the third position without being touched from the outside of the buckle member; and a latch member having a tongue plate to be inserted into the chamber of the buckle member through the opening, wherein the hook engages the tongue plate to let the latch member unable to be detached from the buckle member when the hook is stays at the first position, wherein the hook disengages the tongue plate when staying at the second position;

whereby, by pressing the bearing face of the press button, the stop member is moved backward to the fourth position from the third position, and by exerting a force onto the contact portion, therefore the hook can be moved to the second position, which allows the tongue plate to be disengaged from the hook, so that the buckle member is detached from the buckle member.

2. The safety belt buckle of claim 1, wherein the stop member has a protrusion, and the tongue plate of the latch member has a recess, wherein the protrusion is received in the recess when the stop member is at the third position.

3. The safety belt buckle of claim 2, wherein the recess has a wall, and the protrusion has an engaging face; when the stop member is at the third position, the engaging face of the protrusion touches the wall to stop the tongue plate from moving toward the opening of the buckle member.

4. The safety belt buckle of claim 2, wherein a side of the protrusion is a slope, and a thickness of the protrusion decrease gradually toward the opening of the buckle member.

5. The safety belt buckle of claim 1, wherein the stop member has a stop face, and the hook has an end face; the stop face of the stop member touches the end face of the hook when the stop member is moved to the third position, and therefore stops the hook from being moved to the second position from the first position.

6. The safety belt buckle of claim 1, further comprising a first elastic member received in the chamber of the buckle member to urge the stop member toward the third position.

* * * * *